United States Patent [19]

Gürkaynak et al.

[11] 4,006,582

[45] Feb. 8, 1977

[54] METHOD AND APPARATUS FOR REDUCING THE ELECTRICAL COUPLING IN COMMUNICATING CABLES

[75] Inventors: Erdal Gürkaynak; Jürgen Spatz; Dieter Vogelsberg; Gerhard Liedtke, all of Berlin, Germany

[73] Assignee: Siemens Aktiengesellschaft, Munich, Germany

[22] Filed: July 25, 1974

[21] Appl. No.: 491,753

[30] Foreign Application Priority Data

Aug. 7, 1973 Germany ..... 2340351

[52] U.S. Cl. ..... 57/34 AT; 57/156

[51] Int. Cl.[2] ..... H01B 13/04

[58] Field of Search ..... 57/34 R, 74 AT, 59, 57/66, 156, 166

[56] References Cited

UNITED STATES PATENTS

| | | | |
|---|---|---|---|
| 3,481,127 | 12/1969 | Vogelsberg | 57/34 AT |
| 3,491,525 | 1/1970 | Sugi | 57/34 AT |
| 3,507,108 | 4/1970 | Yoshimura et al. | 57/34 AT |
| 3,572,024 | 3/1971 | Lyons | 57/34 AT |
| 3,643,411 | 2/1972 | Vogelsberg | 57/34 AT |
| 3,645,079 | 2/1972 | Stoebener | 57/34 AT |
| 3,782,092 | 1/1974 | Vogelsberg | 57/34 AT |
| 3,797,217 | 3/1974 | Braun | 57/34 AT |
| 3,823,536 | 7/1974 | Vogelsberg et al. | 57/34 AT |
| 3,884,024 | 5/1975 | Oestreich et al. | 57/34 AT |
| 3,921,381 | 11/1975 | Vogelsberg | 57/156 |

FOREIGN PATENTS OR APPLICATIONS

| | | | |
|---|---|---|---|
| 1,468,382 | 12/1966 | France | 57/34 AT |

*Primary Examiner*—John Petrakes
*Attorney, Agent, or Firm*—Kenyon & Kenyon Reilly Carr & Chapin

[57] ABSTRACT

A method for reducing the electrical coupling in communications cables constructed of bundles in which in a first twisting stage of a two stage operation sections of opposite phase are formed in pairs in the twisted units and in the second twisting stage, adjacent twisted units are related to each other in such a manner that two adjacent twisted units always have the same number or approximately the same number of parallel sections of the same and opposite phase over their entire length. In one disclosed apparatus for carrying out this method an aperture disc, which is rotatable about the twisting axis and whose angular position is variable, is arranged in front of each twisting nipple in the first twisting stage.

13 Claims, 6 Drawing Figures

METHOD AND APPARATUS FOR REDUCING THE ELECTRICAL COUPLING IN COMMUNICATING CABLES

BACKGROUND OF THE INVENTION

This invention relates to communications cables in general and more particularly to an improved method of twisting such cables.

In the manufacture of balanced communications cables, i.e., of cables whose cores are composed of conductors twisted to form pairs or quads, electrical decoupling of the transmission circuits formed by the conductors is, as a rule, done by the manner of twisting. this is accomplished primarily by means of different twists for the individual twisted units such as pairs or quads as well as for the twisted groups formed by these twisted units, such as bundles or twist layers, and also by changes in the twist during the twisting of the twisted units or twisted groups.

Reduction of the electric coupling is obtained in conventional twisting through the use of rotating feeds or rotating take-up devices as well as through the SZ twisting method which has recently been developed and in which the twisting elements are twisted in successive longitudinal sections alternatingly with a left-hand twist (S-twist) and a right-hand twist (Z-twist. Twisting of this kind has an advantage that the elements to be twisted can run off from stationary frames and that the further processing of the SZ-units formed by the twisted elements can follow in the same serial operation. In general, two twisting operations which heretofore have been performed separately, e.g., the twisting of quads to form a base bundle and of base bundles to form a main bundle, but more significantly the twisting of conductors or elements to form quads and the twisting of the quads to form a base bundle, can be combined into a single operation.

In principle, it is also possible, by means of rotating run-offs and/or rotating take-up devices to combine two twisting operations, which have heretofore been performed separately, in a single operation using the conventional twisting method. However, in such a case it is necessary that the run-offs of the material to be twisted as well as the pull-off and take-up device rotate about the twisting axis (Western Electric, The Engineer, July/October, 1971, pages 50 to 55).

For the SZ twisting, which has been developed in more recent times, rotating twisting devices which contain an intermediate accumulator are typically used. In such devices accumulators with fixed storage content which rotate with a speed or direction of rotation which alternates from section to section, while the running speed of the twisted elements is kept constant, can be used. The accumulators of fixed storage content may also rotate with constant speed and direction of rotation, while the running speed of the twisted elements is changed from section to section. A further possibility is that of increasing or decreasing the storage content of the accumulator alternatingly while leaving the rotary motion of the intermediate accumulator unchanged. In addition SZ twisting devices which operate with stationary intermediate accumulators equipped with flying twisting yokes are known. In addition, SZ twisting methods in which, instead of intermediate accumulators, twisting heads which grip the material to be twisted by friction force from the outside with the material being held in a stretched condition within the twisting apparatus are known. In such apparatus either the rotary motion, the physical position or the force transmission of one or more twisting heads or the running speed of the twisted material or the length of the twisting sections formed between the twisting heads and the corresponding twisting points are periodically changed (see the magazine "Draht", vol. 22, (1971) No. 9, pages 619 to 625). Thus, a common factor in all these known SZ twisting methods is that one or more of the process parameters determining the length of lay of the SZ twist units produced, e.g., the speed or direction of rotation of the twisting device or the pull-off speed of the twisting element or the rate of change of the storage content, are changed or reversed at intervals.

In the SZ twisting of conductors to form twisted units, the electrical coupling is detrimentally affected by the reversal points of the twisting direction, in the vicinity of which the conductors are not twisted or only slightly twisted. In order to counteract this effect, a method of arranging the reversal points of the twist direction so that it is staggered in adjacent twist units has been proposed. Furthermore, variation of the lay of the SZ twist and/or the reversal points of the twisting device continuously by a given amount has been suggested in German Auslegeschrift No. 2,213,693. In this manner systematic, i.e., length-proportional, coupling is converted into primarily stochastically distributed couplings which thus increase with length according to a root law, and detrimental coupling is thereby reduced.

Although these methods work well undesirable coupling is still present in the cables. Thus, it is the object of the present invention not only to reduce the effects of systematic coupling in communications cables but to eliminate these effects as completely as possible.

SUMMARY OF THE INVENTION

The present invention starts with a method in which the reduction of the electrical coupling is accomplished by influencing the twisting process in connection with the two-stage twisting of conductors to form twisted units and of twisted units to form twisted groups, the two stages taking place in the same operation. According to the present invention, the phase of the respective conductors forming a twisted unit is changed intermittently or continuously, with the phase sequence remaining the same, in such a manner that pairs of sections of opposite phase are formed. In addition the change of the phase of the twisted units adjacent to each other within the twisted group is related or shifted relative to each other in such a manner that two respective adjacent twisted units have the same or approximately the same number of parallel sections of the same or opposite phase over their entire length.

In the method of the present invention pairs of sections of opposite phase are therefore first formed for the conductors in each twisted unit, i.e., with each length element of the twisted unit there is associated, at a distance which is an integral multiple of the length of lay of the twisted unit, another length element which differs as to phase from the first length element by 180° or approximately 180° or an odd multiple of 180°. In the simplest case the sections of opposite phase alternate within the respective twisted unit, i.e., the phase at the beginning of a lay will have one of the two values zero or 180° or an odd multiple of 180°. However, it is also possible to vary the phase at the beginning of each lay in steps, so that within the twisted unit, one or more sections of different phase or phases are formed between two sections of opposite phase. It is possible, for instance, to proceed so that, within the respective twisted unit, sections with the phases 0°, +90°, +180° and −90° alternate in regular sequence. This is particularly advantageous for the decoupling not only of the physical circuits, e.g., adjacent quads, but also decoupling of the phantom circuits. In all these cases the phase is changed in a stepwise manner at intervals, e.g., within the time required for the manufacture of one or several twisting lays.

To keep the amount of apparatus required for carrying out the present method as simple as possible, the sections of equal phase should not be too short. However, in order to insure the effectiveness of the present method the sections of equal phase should not be too long. To optimize these countervailing requirements sections about 20 to 200 m long are suitable. Howeven, when considering step-wise variation of the phase, continuous variation, for instance, as a triangular or sinusoidal function, must also be considered. In such a case the phase of the conductors of a twisted unit changes continuously from one lay unit to the next by differently small amounts. The intervals, at which a corresponding length element of opposite phase is caused to occur for a length element of the twisted unit of a given phase, are advantageously again in the order of 20 to 200 m.

In accordance with the present invention, in order to insure the decoupling of the twisted units which are stranded to form a twisted group, it is necessary not only that a definite phase sequence be maintained within each twisted unit, but that a definite relationship between adjacent twisted units with regard to parallel sections of the same and opposite phase also be maintained. Attention must be directed to the fact that two respective twisted units have the same or approximately the same parallel sections of the same and opposite phase over their entire length. If therefore the phase sequence in one of two adjacent twisting units assumes the two values 0 and 180° at spacings of 100 m, for instance, then a proper relationship will exist when this same phase sequence is present in the adjacent twisted unit at the same spacings, but shifted by 50 m. Alternatively the phase can assume the values 0 and 180° at spacings which correspond to an integral multiple or an integral part of the spacing in the first twisted unit.

In view of the decoupling of the adjacent twisted units, the present invention starts out from the premise that the coupling to be eliminated is a systematic coupling, and in the case of twisted groups composed of quads, in particular, what is known as adjacent-quad coupling, which is best reduced by systematic decoupling measures. With this in mind it can be seen that with this method the interference voltages coupled into the transmission circuits or the transmission circuit of a twisted unit exhibit a positive or negative sign alternating from section to section, corresponding to the parallel sections of the same or opposite phase. Thus, an alternating sequence of positive and negative couplings of the same magnitude which cancel each other results.

The two-stage twisting of conductors to form twisted units and of the twisted units to form twisted groups is generally accomplished in an SZ twisting operation at least in the first twisting stage, i.e., twisted units with a twist direction changing from section to section are formed. Applying the decoupling method of the present invention in two-stage twisting operations where the first operation is a SZ twisting operation a particularly advantageous embodiment is that of varying the phases within the twisted units at spacings which correspond to an integral multiple of an SZ period, i.e., to an integral multiple of twice the distance between reversal points of twist direction. In this case, a step-wise change of the phase can be made in conjunction with reversal operations in carrying out the SZ twisting.

For varying the phase in SZ twisting operations it is advisable to proceed such that the number of lays present within the respective SZ stranding equipment is increased or decreased alternatingly, continuously by one pitch length or an integral multiple thereof, or step-wise by one-half pitch or an odd multiple thereof. This step can be carried out in all known SZ twisting methods, i.e., in SZ twisting methods which operate with intermediate accumulators, as well as in SZ twisting methods in which the twisted elements are stranded in stretched condition by means of twisting heads.

For implementing the decoupling method of the present invention, an apparatus in which for each twisted unit there is arranged between the conductor supplies in the first twisting stage and the second twisting stage a twisting nipple, into which the conductors of the respective twisted unit to be formed run is well suited. In accordance with a further embodiment of the invention an aperture disc is arranged ahead of the respective twisting nipple. The aperture disc is rotatable about the twisting axis and determines the phase sequence of the conductors. Preferably its angular position can be varied continuously through 360° or through integral multiple thereof or step-wise at spacings of 90° and/or 180° or an odd multiple thereof, or alternatingly in the one and the other direction. Such aperture discs are well known in the art having previously been either as stationary guides for the twisting elements to be twisted or have been oscillated about the twisting axis for the twisting of the strand elements (German Pat. No. 610,650). In the manufacture of bundles of eight conductors arranged in a layer, such aperture discs have also been used for transposing the conductors (German Auslegeschriften No. 1,111,254 and 1,159,059).

The use of an aperture disc whose position changes continuously or at intervals, is possible in all two-stage twisting methods, i.e., in those in which the conductors are twisted in the first twisting stage with the direction of twist remaining constant, as well as in those in which the conductors are twisted in the first twisting stage with a twist direction which changes from section to section. In two-stage twisting operations in which the conductors are twisted in the first twisting stage using intermediate accumulators with the twist direction changing from section to section, an apparatus in which the distance between the storage element and the twisting nipple arranged ahead of or behind the storage element or a corresponding deflection pulley is variable in steps can also be used for implementing the present method. Also usable is apparatus in which the rotary motion or the storage content of the storage element of the respective intermediate accumulator is changeable in steps. If, however, SZ twisting devices which operate in the first twisting stage with torsioning sections and with twisting heads gripping the twisted units with positive force transmission are provided it is advisable that phase be varied by means of a rotating or a stationary twisting head whose position is variable in the longitudinal direction of the material to be stranded or whose rotary motion or force transmission is variable. In such apparatus it is also possible to vary the phase, by making the length of the torsioning section of the respective SZ twisting device variable in steps.

In a two-stage twisting operation in which SZ twisting is performed in the first twisting stage, it can be said in summary that the change of the phase of the conductors within one twisted unit can be brought about in principle by changing any parameter which also is a determining factor in the SZ twisting of the conductor itself, for example, the rotary motion or the force transmission of a twisting head, the length of a torsioning section, and the rotary motion or the storage content of an intermediate accumulator.

DETAILED DESCRIPTION OF THE PREFERRED EMBODIMENT

Figure 1:
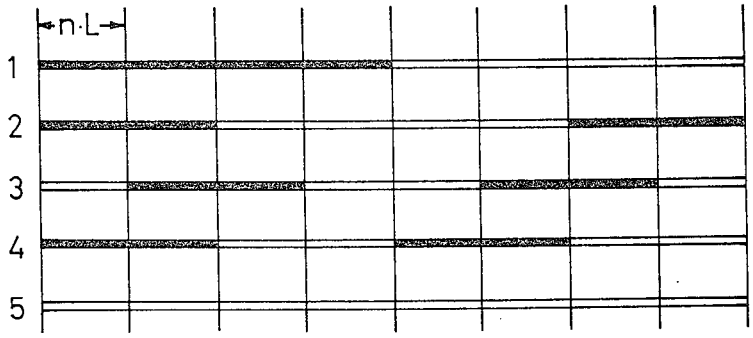
FIGS. 1 and 2 are diagrams illustrating the method of the present invention.
Figure 2:
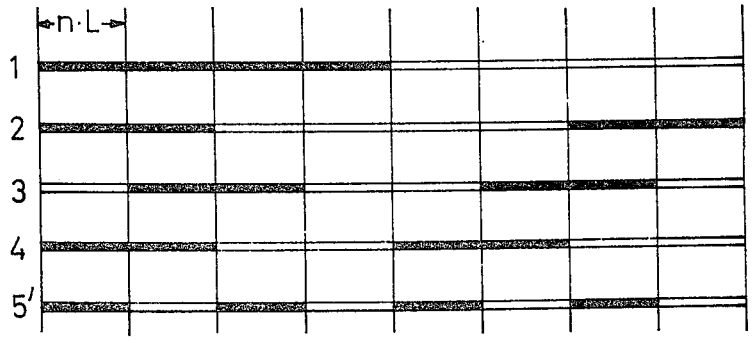

FIGS. 1 and 2 and diagrams illustrating the phase sequence of the various quads (or units) along with the mutual relationship of the quads of a base bundle or group composed in each case of five quads. These are quads which are made by an SZ twisting process, so that they have alternating sections with opposite direction of twist. The length of two sections of opposite direction of twist, i.e., the length of a so-called SZ period, is designated in the diagrams by the letter L with the quantity n.L indicating an integral multiple of the length of such an SZ period.

On FIG. 1 the phase of the quads 1 and 2 changes in intervals which correspond to four times the length of n.L. For the quads 3 and 4, the phase is changed in intervals which correspond to twice the length of *n*.L, i.e., it is changed at twice the frequency of the quads 1 and 2. For the quad 5, however, no change of the phase is provided. In the illustration, the heavy line indicates that the respective quad is in its original position; the double line signifies that that quad is in a position rotated by 180°.

The mutual relationship of the phases of the individual quads is chosen so that between two adjacent quads (in the base bundle, each quad is adjacent to every other quad) equally long parallel sections of the same and opposite phase occur. This is achieved by providing that for the quads 1 and 2 the basically equal phase sequence is shifted by half the length of a section with the phase remaining the same. The same is true with respect to the quads 3 and 4, the quad 4 beginning with the same phase as the quad 1. The decoupling of the quad 5 from the quads 1 to 4 is accomplished automatically by the uniform change of the phase in the quads 1 to 4.

The diagram of FIG. 2 differs from the diagram of FIG. 1 in that variation of the phase for the quad 5′ is provided. The frequency of the phase change is twice the frequency of the phase change in the quads 3 and 4, with the phase likewise assuming alternatingly the two values 0 and 180°.

Figure 3:
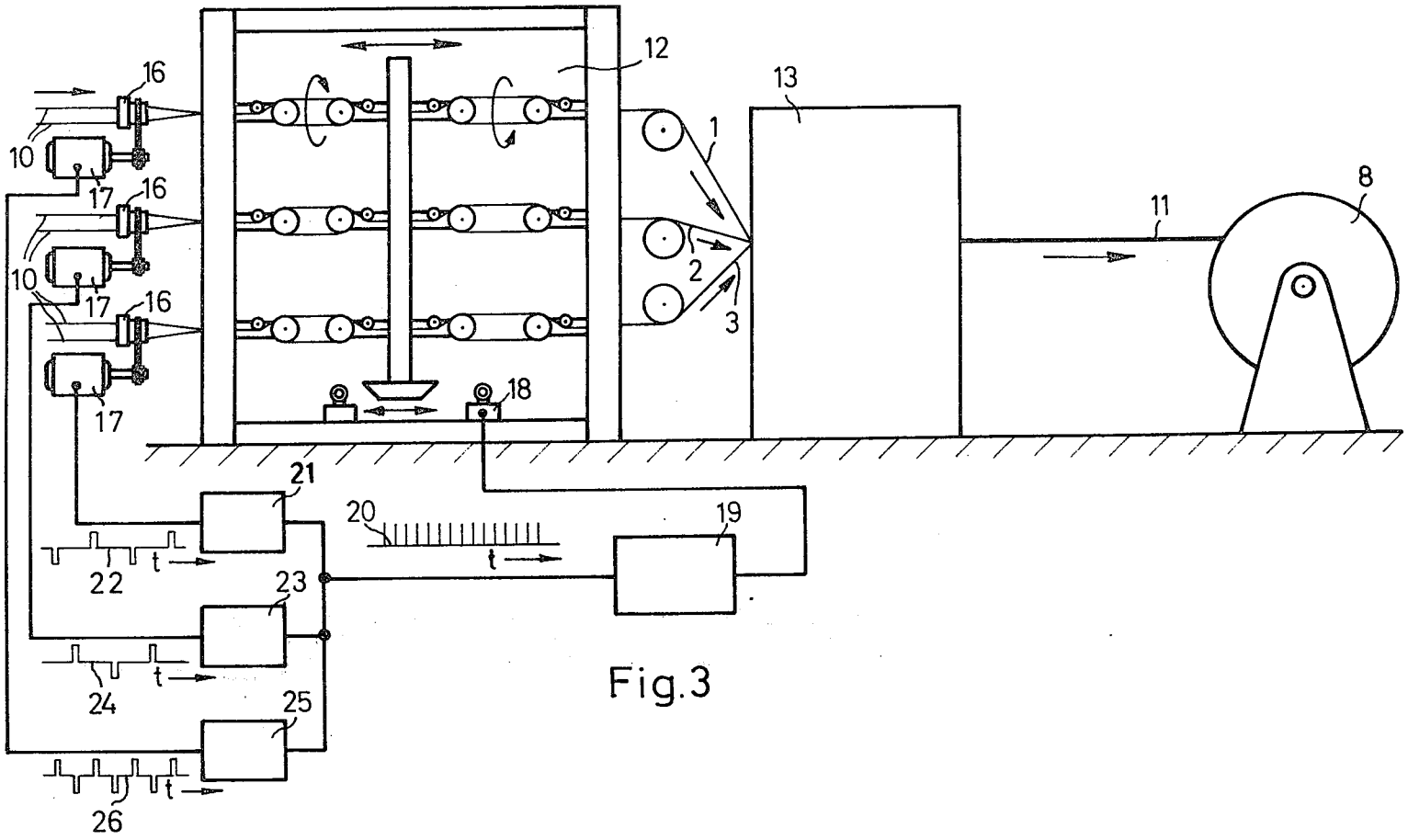
FIG. 3 illustrates a first embodiment of a device for carrying out the method of the present invention.
Figure 4:
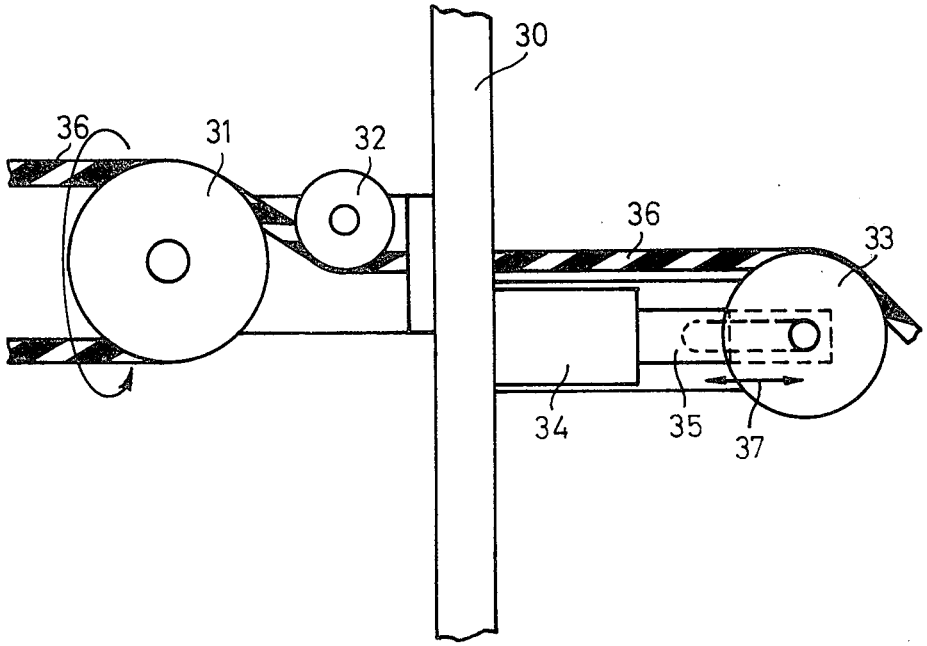
FIG. 4 illustrates a portion of a second apparatus for carrying out the method.
Figures 5, 6:
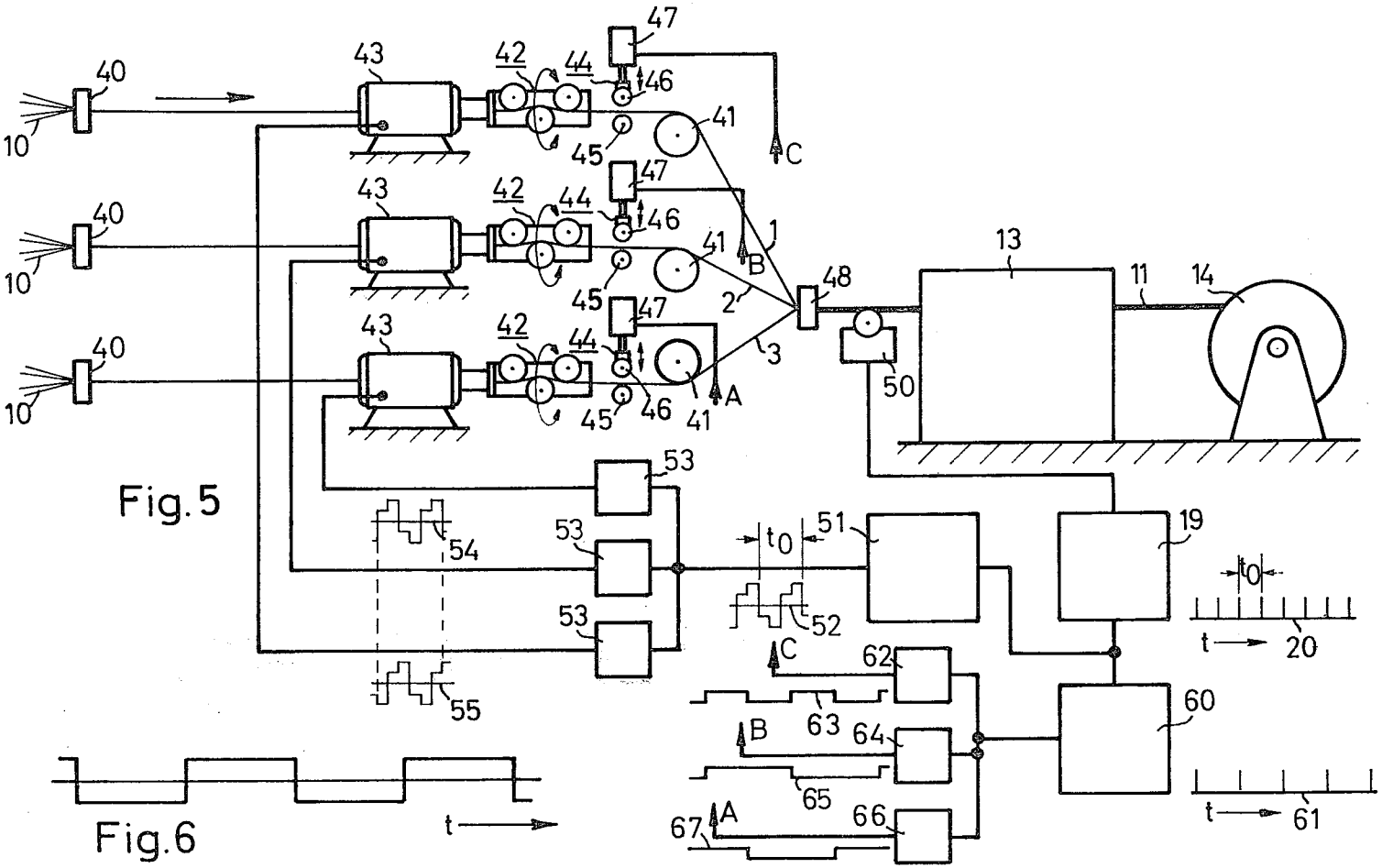
FIG. 5 is an illustration of a third apparatus which can be used in carrying out the method.
FIG. 6 is a wave form diagram of the type of pulse train which can be used in controlling the apparatus of FIGS. 3, 4 and 5.

FIGS. 3 to 5 are examples of embodiments of apparatus for implementing the decoupling method of the present invention in which base bundles which are decoupled in the manner shown in FIGS. 1 and 2 can be produced.

With the twisting machine shown in FIG. 3, the conductors 10, which run off from stationary conductor supplies, not shown in detail, are twisted in a first twisting stage 12 using a well known type of SZ twisting device in the form of a rotating intermediate accumulator of varying storage content to form SZ-twisted quads 1, 2 and 3. These quads are subsequently twisted in a second SZ twisting stage 13 together with two further quads (not shown for sake of simplicity) to form the base bundle 11 which is then wound on a drum by means of the pulling and take-up device 8.

Before the conductors 10 run into the respective twisting nipple of the twisting device of the first twisting stage 12, the conductors are run through aperture discs 16 of conventional design commonly used for twisting conductors or quads and which determine the constant phase sequence of the conductors 10. The aperture discs 16 are mounted for rotation about the respective twisting axes. The angular position of the aperture disc is adjustable using a d-c motor 17 with suitable transmission. The motors 17 are controlled in response to a limit switch 18, which is arranged in the first SZ twisting stage 12 and is actuated at a reversal of this SZ twisting device from an increase of the storage content to a decrease of the storage content of the intermediate accumulators contained in the twisting machine. Actuation of switch 18 which is an input to a pulse generator 19 causes an output pulse therefrom. The pulse train delivered by pulse generator is designated 20. Pulse generator 19 may simply be a one shot multivibrator response to the activation of switch 18. Pulse generator 19 feeds counters and pulse shapers 21, 23 and 25, which in turn deliver the pulse sequences designated with 22, 24 and 26 to the motors 17. The length of the individual pulses is chosen so that the motors 17 drive the aperture discs 16 half a revolution in the one or the other direction and thereby change the phase of the conductors 10, at intervals which correspond to the phase sequence, by 180° in the one or the other direction. The pulse trains 22, 24 and 26 are matched to each other here in such a manner that the phase sequence shown in FIG. 1 is obtained for the quads 1, 2 and 3. Each of counter and pulse shaper devices 21, 23 and 25 can contain conventional binary counters to properly divide the pulse train 20, one shot multivibrators to obtain the necessary pulse length along with a drive circuit responsive thereto to supply the motor current.

It is also possible to continuously change the phases of the conductors 10 twisted to form the quads 1, 2 and 3 with the apparatus of FIG. 3. If the phase of the conductors is to be changed, for instance, according to a triangular function, the time functions delivered by the pulse generators 21, 23 and 25 will be adjusted to correspond to an alternating squarewave function, as shown in FIG. 6 for the pulse generator 21.

FIG. 4 which shows, in a section, the output portion of an accumulator SZ twisting device illustrates another embodiment for carrying out the method of the present invention. The pulley 31 of the storage element of the intermediate accumulator, fastened at a mounting not specifically designated, is supported, along with the deflection pulley 32, in the stationary frame 30. The pulleys 31 and 32 rotate about the twisting axis together with the mounting. The material to be twisted, e.g., a quad, runs through the intermediate accumulator from left to right and is led via the deflection pulley 33, which is stationary with respect to the twisting axis, outside the intermediate accumulator. The deflection pulley 33 is rotatably supported on the armature 35 of an electromagnet 34. When the electromagnet is energized, the armature executes a sudden movement in the lengthwise direction of the twisting axis of the intermediate accumulator as illustrated by arrow 37. The degree of this lengthwise movement is selected, in accordance with the lay of the material 36 to be twisted, in such a manner that the change of the position of the deflection pulley 33 is accompanied by a change of the phase of the material 36 to be twisted by 180° in the one or the other direction. The electromagnet 34 is driven by appropriate pulse generators in the same manner as the drive of the motors 17 in FIG. 3. The pulse sequence delivered by the pulse generators is an alternating squarewave function such as that of FIG. 6, where only positive or negative pulses are delivered. During the intervals between the individuals pulses, the armature 35 is held in a rest position by a restoring spring, not specifically shown.

A further embodiment of twisting apparatus for carrying out the present invention is shown on FIG. 5. In this device, conductors 10 are twisted in a first twisting stage to form five quads, of which only three quads 1, 2 and 3 are shown for reasons of clarity, and the quads then twisted in a second twisting stage using the bundle twisting device 13 to form the base bundle 11 which is then wound on a drum by means of the pull-off and take-up device 14. The twisting of the conductors 10 to form quads is accomplished with rotating twisting heads 42, which are arranged in a conventional known manner within a twisting section formed respectively by a twisting nipple 40 and a deflection pulley 41. These twisting heads are driven by d-c motors 43 which have a hollow shaft for letting the material to be twisted pass through.

Behind the twisting nipple 48 of the second twisting stage, a length counter 50 which triggers the pulse generator 19 to deliver the pulse train 20 as a function of the length of the quad produced in the first twisting stage is placed. Length counter 50 may simply be an angular shaft encoder having on its shaft a pulley or the like in contact with the bundle 11. The pulse width $t_0$ corresponds to the length of a section of constant twist direction of the quads produced. The pulse width delivered by the pulse generator 19 acts on the pulse transformer 51, which delivers the periodic staircase function designated 52, whose period corresponds to the pulse spacing $t_0$ of the pulse sequence delivered by the pulse generator 19. Various ways of constructing such a staircase generator will be suggested to those skilled in the art. For example, an integrator may be started with each pulse of pulse train 20 with its output provided to a group of comparators to divide the period into four segments. The comparator outputs can then be used to gate out the desired voltage level for each segment. This staircase function drives the d-c motor 43, so that the speed and direction of rotation of these motors are changed in accordance with the staircase function 52. By means of the phase shifter 53 the drive of the individual motors 43 is then shifted in time as shown by waveforms 54 and 55. In accordance with the example of generating a staircase given above, the comparator outputs can be used in each individual phase shifter to gate out the desired level for each segment $t_0$. As a result the reversal points of the twist direction of the individual quads 1 to 3 in the base bundle 11 are displaced relative to each other in the lengthwise direction.

The pulse sequence 20 generated by the pulse generator 19 at the same time drives the pulse divider 60 (which may simply be a binary counter) providing a pulse train 61 as an output. The spacing of the individual pulses in pulse train 61 corresponds to an integral multiple of the pulse spacing of the pulse train delivered by the pulse generator 19. The pulse train 61 drives the pulse counters and pulse shapers 62, 64 and 66, which in turn deliver the squarewave pulse trains 63, 65 and 67. These pulse trains feed means 44 for selectively gripping the material to be twisted, which each comprise a stationary guide pulley 45, a roller 46 which can be moved perpendicularly to the axis of the material to be twisted, and an electromagnet 47, to the armature of which the roller 46 is fastened. The gripping means 44 are therefor means which selectively grip the material passing between the pulley 45 and the roller 46 and which do so according to the time cycle of the pulse trains 63, 65 and 67. Through this arrangement of pulleys, when the material is gripped, longitudinal motion in the direction of travel of the material is permitted but rotation thereof is stopped. Through the selective gripping of the material by the gripping means 44, the length of the respective torsioning section, on which the revolving twisting heads 42 act, is changed in step-wise fashion at intervals. This results in a sudden change of the phase of the conductors 10 within a respective quad. With the correct choice of the distance between the stationary gripping means 44 and the deflection pulley 41, this change is 180°, so that the phases of the quads produced in the first twisting stage in parallel operation have the values 0° and 180° at spacings corresponding to the waveshape of the pulse trains 63, 65 and 67. Through control of the length of the squarewave pulses 63, 65 and 67 as well as their relation in time, it is insured that the individual quads of the base bundle 11 are related to each other in the manner shown in FIGS. 1 and 2, so that the decoupling of the transmission circuits of the base bundle 11 is obtained in accordance with the method of the present invention.

In embodiments shown in FIGS. 3 and 5 the twisting of conductors to form quads and the subsequent twisting of the quads to form a base bundle was described. The twisting devices shown and the decoupling methods described with reference to these devices can be applied in a similar manner to the twisting of conductors to form pairs or triplets and for the subsequent twisting of the pairs or triplets to form a bundle. These and other modifications may be made without departing from the spirit of the invention which is intended to be limited solely by the appended claims.

What is claimed is:

1. A method for reducing the electric coupling in communications cables by influencing the twisting process in a two-stage twisting of conductors to form twisted units and of twisted units to form a twisted group taking place in the same operation, particularly in the two-stage twisting of conductors to form pairs or quads and of the pairs or quads to form a bundle comprising:

a. forming respective twisted units in which the phase of the conductors is changed such that pairs of sections of opposite phase with the phase sequence remaining the same are formed; and b. twisting the units so formed into a group in which the changes of the phase of the twisted units adjacent to each other within the twisted group are related to each such that two respective, adjacent twisted units have at least approximately the same number of parallel sections of the same and opposite phase over their entire length.

2. The method according to claim 1 wherein the changes of the phase are made gradually.

3. The method according to claim 1 wherein sections of opposite phase alternate within the respective twisted unit.

4. The method according to claim 1 wherein within the respective twisted unit, between two sections of opposite phase, at least one section of another phase is formed.

5. The method according to claim 1 wherein the changes of the phases are made in steps.

6. The method according to claim 5 wherein sections of opposite phase alternate within the respective twisted unit.

7. The method according to claim 5 wherein within the respective twisted unit, between two sections of opposite phase, at least one section of another phase is formed.

8. The method according to claim 7 wherein sections of the phase 0°, +90°, +180° and −90° alternate in a regular sequence within the respective twisted unit.

9. The method according to claim 1 for use in two-stage twisting processes, in which the first twisting operation is a SZ twisting operation which leads to twisted units with a twist direction alternating section by section, and further comprising changing the phases at intervals which correspond to an integral multiple of an SZ period.

10. The method according to claim 9 wherein the number of lengths of lay present within the respective SZ twisting device is increased or decreased alternating one of continuously by one of a length of lay and an integral multiple thereof and stepwise by one of a half length of lay and an odd multiple thereof.

11. Apparatus for reducing the electrical coupling in communication cables by influencing the twisting process in a two stage twisting of conductors to form twisted units and of twisted units to form a twisted group taking place in a same operation comprising:

a. a twisting nipple for each unit into which the conductors of the respective twisting unit to be formed are led, said nipple arranged between the conductor supplies in the first twisting stage and a second twisting stage;

b. an aperture disk arranged ahead of each twisting nipple and supported for rotation about the twisting axis to control the phase sequence of the conductors; and c. means to vary the angular position of said disk one of continuously through 360° × $n$ where n is an integer at least equal to one and in step wise intervals of one of 90°, 180° and an odd multiple thereof in one of a constant direction and alternatingly in one and the other direction.

12. In a twisting apparatus arranged to perform a two stage twisting of conductors to form twisted units and of twisted units for form a twisted group taking place in the same operation, the apparatus performing the first twisting operation being an SZ twisting apparatus which leads to twisted units having a twist direction alternating section by section, means for reducing the electrical coupling in communication cables formed in the apparatus by influencing the twisting process comprising:

a. a plurality of SZ twisting devices of the type having intermediate accumulators used as the first twisting stage;

b. a stationary support means on one side of each intermediate accumulator;

c. means to vary the distance between said stationary support means and said accumulator in intervals so as to form respective twisted units in which the phase of the conductors is changed such that pairs of sections of opposite phase with the phase sequence remaining the same are formed; and d. means for twisting the units formed in said first twisting stage into a group in which the changes of phase of the twisted units adjacent to each other within the twisted group are related to each other such that two respective, adjacent twisted units have at least approximately the same number of parallel sections of the same and opposite phase over their entire length.

13. In a twisting apparatus arranged to perform a two stage twisting of conductors to form twisted units and of twisted units to form a twisted group taking place in the same operation, the apparatus performing the first twisting operation being an SZ twisting apparatus which leads to twisted units having a twist direction alternating section by section, means for reducing the electrical coupling in communication cables formed in the apparatus by influencing the twisting process comprising:

a. a plurality of SZ twisting devices for the first twisting stage each of which includes a rotating twisting means and a fixed twisting point to establish a torsioning section and each also having means disposed between said rotating means and fixed point to selectively grip the conductors so as to prevent rotation but permit longitudinal motion therethrough to thereby shift the fixed point of the torsioning section; and b. means for varying in intervals the gripping operation of said means to grip in said twisting device so as to form respective units in which the phase of the conductors is changed such that pairs of sections of opposite phase with the phase sequence remaining the same are formed; and e. means for twisting the units formed in said first twisting stage into a group in which the changes of phase of the twisted units adjacent to each other within the twisted group are related to each other such that two respective, adjacent twisted units have at least approximately the same number of parallel sections of the same and opposite phase over their entire length.

* * * * *